US005217132A

United States Patent [19]

Looker

[11] Patent Number: 5,217,132

[45] Date of Patent: Jun. 8, 1993

[54] CONVERTIBLE AIR CARGO CONTAINER

[76] Inventor: Robert Looker, 1509 E. El Segundo Blvd., El Segundo, Calif. 90245

[21] Appl. No.: 923,009

[22] Filed: Jul. 30, 1992

Related U.S. Application Data

[63] Continuation of Ser. No. 737,445, Jul. 29, 1991, abandoned.

[51] Int. Cl.[5] ..... B65D 6/18

[52] U.S. Cl. ..... 220/1.5; 220/8; 220/331; 190/1

[58] Field of Search ..... 244/118.1, 137.1; 190/1; 220/1.5, 8, 331, 346, 345, 666, 212, 9.2

[56] References Cited

U.S. PATENT DOCUMENTS

| | | | |
|---|---|---|---|
| 1,597,092 | 8/1926 | McTighe | 220/331 |
| 1,912,787 | 6/1933 | Neis | 190/1 |
| 2,141,861 | 12/1937 | Hahn et al. . | |
| 2,407,774 | 9/1946 | Fowler . | |
| 2,761,581 | 9/1956 | Cohee . | |
| 3,084,825 | 4/1963 | Hultquist | 220/8 |
| 3,294,034 | 12/1966 | Bodenheimer et al. | 244/118.1 |
| 3,344,831 | 10/1967 | Brackett | 220/8 |
| 3,432,248 | 3/1969 | Retzler | 220/331 |
| 3,539,070 | 11/1970 | Dunlea, Jr. | 220/8 |
| 3,672,529 | 6/1972 | Feddersen et al. | 220/331 |
| 3,677,433 | 7/1972 | Collins . | |
| 3,706,392 | 12/1972 | Sprick et al. | 220/331 |
| 3,860,138 | 1/1975 | Lovich et al. | 220/331 |
| 3,904,064 | 9/1975 | Looker | 220/346 |
| 3,915,327 | 10/1975 | Lovich et al. . | |
| 3,955,702 | 5/1976 | Lundy . | |
| 3,961,723 | 6/1976 | Eckel | 220/331 |
| 3,972,437 | 8/1976 | Lovich et al. . | |
| 4,008,936 | 2/1977 | Meller et al. . | |
| 4,046,277 | 9/1977 | Morrison . | |
| 4,216,927 | 8/1980 | Byrd | 244/118.1 |
| 4,260,069 | 4/1981 | Juergens | 220/331 |
| 4,497,525 | 2/1985 | Mittelman . | |
| 4,538,663 | 9/1985 | Looker . | |
| 4,717,020 | 1/1988 | Viira | 220/331 |
| 4,747,504 | 5/1988 | Wiseman et al. | 220/1.5 |
| 4,932,547 | 6/1990 | Rodriquez | 220/331 |

FOREIGN PATENT DOCUMENTS

| | | | |
|---|---|---|---|
| 369575 | 5/1990 | European Pat. Off. | 244/118.1 |
| 53945 | 1/1947 | France . | |
| 1345101 | 10/1963 | France . | |
| 275863 | 8/1927 | United Kingdom . | |
| 2040882 | 9/1980 | United Kingdom | 220/8 |

OTHER PUBLICATIONS

Technical specification sheet for M1 air cargo container.

Technical specification sheet for A07 air cargo container.

PCT Search Report for Appln. PCT/US91/03622 and PCT Search Report for Appln. PCT/US91/03577.

EPO Search Report dated 19 Mar. 1990 in copending Appln. No. 89 307953.3.

*Primary Examiner*—Allan N. Shoap
*Assistant Examiner*—S. Castellano
*Attorney, Agent, or Firm*—Lyon & Lyon

[57] ABSTRACT

A convertible air cargo container which may be used in the air freight industry. A slidable top cover allows the user to convert a standard cube shaped cargo container, for example, in an M1 configuration, to an AQ7 configuration. Secured to the slidable top cover by a hinge is at least one contoured flap which rotates to alter the upper shape of the cargo container for use in other types of aircraft or other cargo carrier. A piston and spring lock secures the top cover and contoured flaps into the desired position.

14 Claims, 2 Drawing Sheets

CONVERTIBLE AIR CARGO CONTAINER

This is a continuation of co-pending application Ser. No. 07/737,445, filed on Jul. 29, 1991 now abandoned and which designated the U.S.

BACKGROUND OF THE INVENTION

1. Field of the Invention

The invention herein described and claimed relates generally to cargo containers and more particularly, to convertible cargo containers for use in various aircraft.

2. Prior Art

Since the earliest days of manned flight, cargo of one type or another has been transported in planes. From the early flights when the cargo was principally mail, to modern day jet aircraft and their tremendous payloads, the air cargo industry has been engaged in a constant effort to fly more cargo farther, faster and cheaper. Air cargo transporters attempt to maximize the load on each aircraft while at the same time keeping the weight of the cargo as low as possible, to speed up the loading and unloading process, and to reduce their investment in air cargo equipment. Also, the rigors of air travel require that such on-board equipment be safe.

For example, it is standard in the industry today that commercial cargo is first loaded into containers on the ground, and the containers are then loaded onto and unloaded from the plane. This saves time and is more secure in-flight. The mostused air cargo container is an aluminum monocoque structure, usually cubic or roughly cubic in shape. Because it is desirable to use as much of the available fuselage space of the plane as possible, these containers are typically designed so that their exterior configuration generally mates with the interior fuselage configuration of the plane. Because the different aircraft used in commercial air cargo transportation (the Boeing 747 and DC-10, for example) have different size and shape fuselages, the air cargo containers designed for use in them likewise have differing shapes.

Thus, for carriers with different aircraft, such as the Boeing 747 and the McDonnell Douglas DC-10, the prior art systems require these companies to purchase at least two different models of cargo containers, the M1 and the AQ7. Both prior art containers have the same general rectangular base configuration of approximately 96 inches by 125 inches. The M1 container, which is generally cube shaped, is the preferred container for the DC-10 aircraft. As shown on the accompanying Information Disclosure Statement, the M1 container has a uniform height of approximately 96 inches. However, for the 747 aircraft, the AQ7 container is preferred because its contoured shape and greater height better resemble the interior cargo cabin of this aircraft. As shown in the Information Disclosure Statement, the height of the AQ7 container varies, with a maximum height dimension of approximately 118 inches. If the M1 container is used on the 747, a large portion of available cargo space is not utilized and efficiency suffers. Furthermore, the AQ7 is not useable on the DC-10 aircraft. Thus, the carriers must purchase two different cargo containers, idling either the M1 or AQ7 containers for some time, and thereby increasing the cost of shipping by air.

Therefore, there exists a need for an improved cargo container whose shape and size can be changed for use on different aircraft and thereby maximize the use of the available cargo space, while minimizing the fleet of containers required. This preferred cargo container would not only be strong, durable and lightweight, but would also be more economical to use by being convertible for use on different aircraft. Furthermore, this container must still be easy to use.

SUMMARY OF THE INVENTION

The present invention provides an improved convertible cargo container, which maximizes the use of the available cargo space and at the same time is still easy to use. The improved cargo container of the present invention can be converted for use in either an M1 configuration or the AQ7 configuration.

This convertible container has a top cover which is slidably secured to an open lower box structure. A contour flap secured to the top cover by a hinge allows the user to modify the shape of this cargo container to closely fit the contours of the chosen aircraft, such as a 747. To change the height configuration of the container, the top cover is moved along the perimeter of the lower box portion until the top cover is secured by pre-positioned locking means on the box structure. The contour flap is then rotated into position and is also secured by the locking means. The locking means may be of a piston and spring type.

Access to the interior of this cargo container is through one or more doors positioned on the lateral sides of the box structure. These doors provided on the present invention may be of the type as disclosed in U.S. Pat. No. 4,538,663 issued to Looker for a Cargo Container. This patent is hereby incorporated by reference herein.

The present invention is not limited to either an M1 or AQ7 configuration but includes other specific transport problems. Therefore, a further aspect discloses a method of converting a cargo container from one configuration to another.

Accordingly, it is an object of the present invention to provide an easy to use convertible cargo container. Other and further objects and advantages will appear hereinafter.

DETAILED DESCRIPTION OF THE PREFERRED EMBODIMENT

Figure 1A:
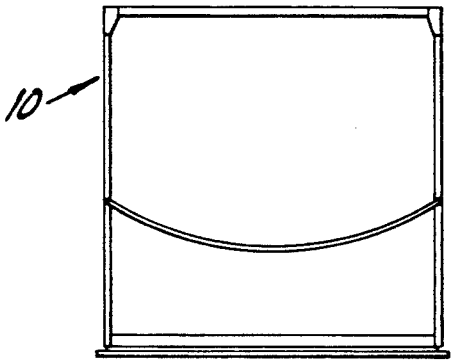
FIG. 1a. PRIOR ART
FIG 1*a* is an elevation view of a prior art cargo container in the M1 configuration.
Figure 1B:
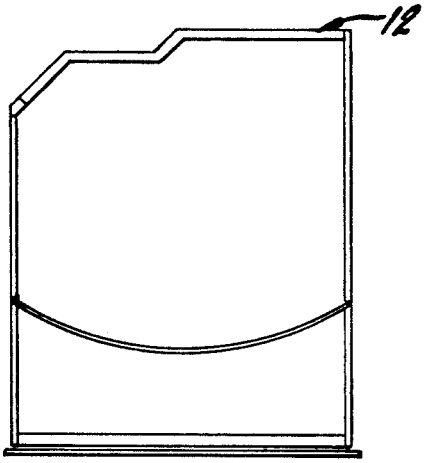
FIG. 1b. PRIOR ART
FIG. 1*b* is an elevation view of a prior art cargo container in the AQ7 configuration.
Figure 2:
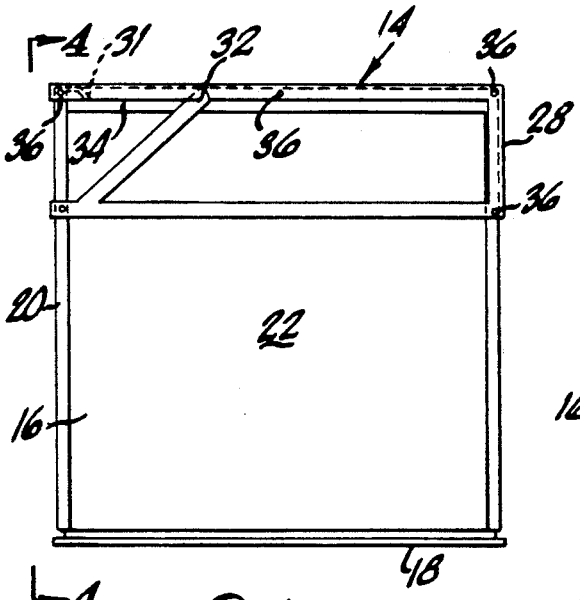
FIG. 2 is a side elevation view of the preferred embodiment of the present invention.

Looking first at FIGS. 1*a* and 1*b*, the prior art cargo containers 10 and 12 are shown. FIG. 1*a* is a side view of the standard M1 cargo container 10. In FIG. 1*b*, the contoured AQ7 cargo container 12 is shown. The cargo container 14 in the preferred embodiment of the present invention is shown in FIG. 2. The lower box structure 16 is comprised of a base 18 which is secured to the aircraft and support posts 20 which project up from the base 18. Side sheets 22 extend between the support posts 20 to form the lower box structure 16. These side sheets 22 are made of aluminum in the preferred embodiment. At least one of the side sheets 22 has a door opening 24 thereon which is provided a door 26 for access to the interior of the cargo container 14.

Figure 3:
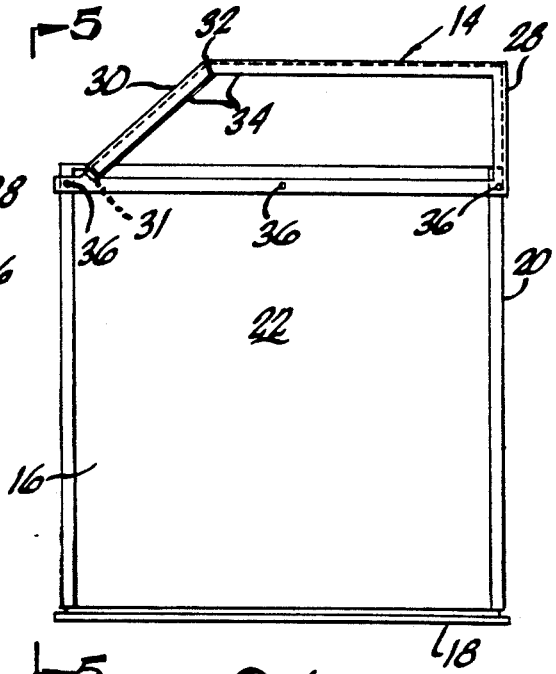
FIG. 3 is a side elevation view of the preferred embodiment with the slidable top cover extended.
Figure 4:
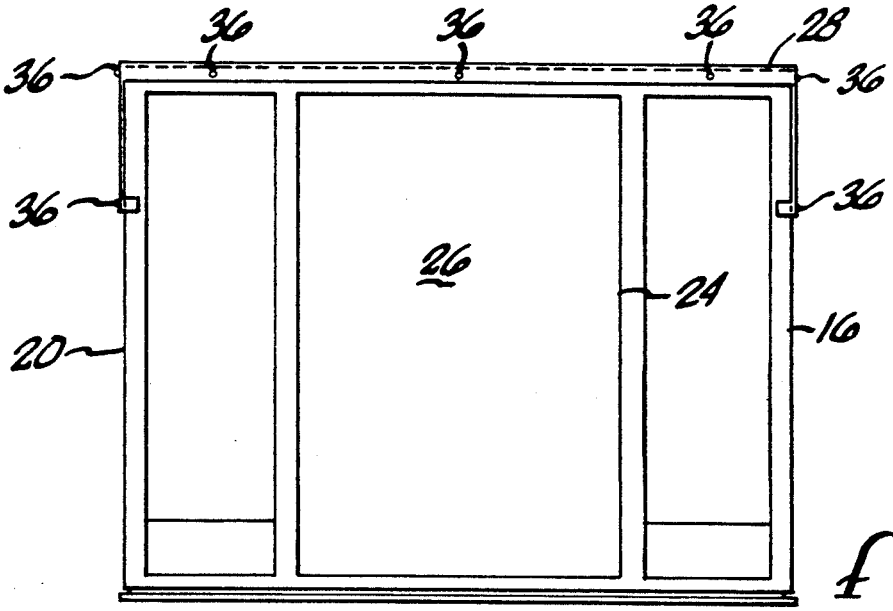
FIG. 4 is an elevation view taken along line 4—4 of FIG. 2.
Figure 5:
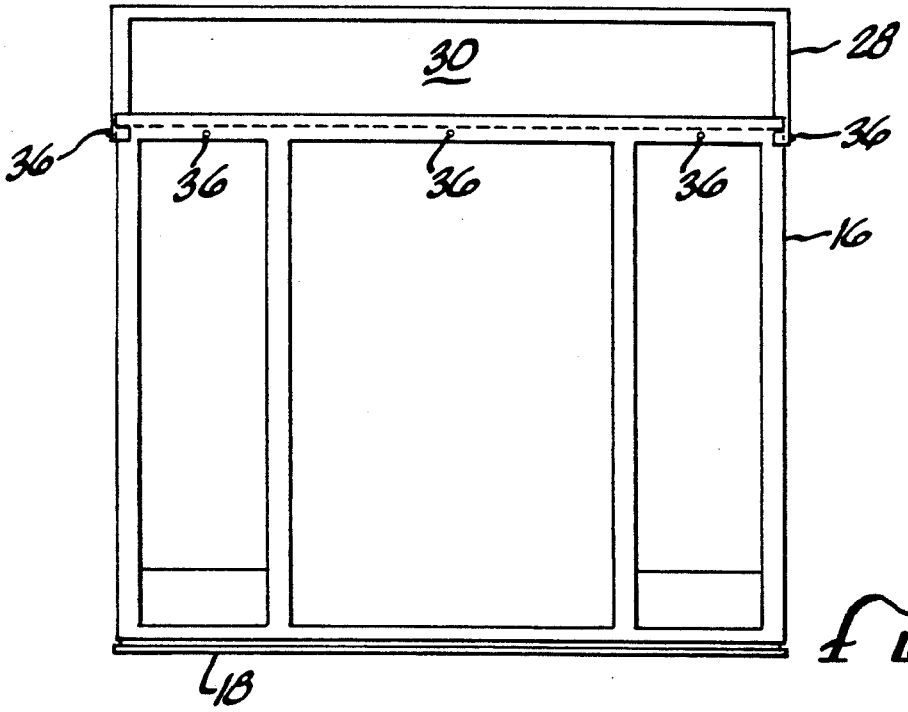
FIG. 5 is an elevation view taken along line 5—5 of FIG. 3.

The convertible aspect of the present invention is the upper part of the cargo container 14. The simplicity of this invention and the ease in which it operates is the hallmark of a true invention. Covering the upper opening is a slidable top cover 28, which is moved vertically along a portion of the perimeter of the side sheets 22 of the lower box structure 16 to convert from one configuration to another. A contour flap 30 is secured by a hinge means 32 to the top cover 28 which allows the flap 30 to adjust to the desired configuration to substantially conform to the interior shape of the cargo carrier. Notches 31 are provided at upper edges of the box structure 16 to allow the contour flap 30 to rotate down to contact the top cover 28 when the top cover 28 is raised. This is shown in FIGS. 2 and 3. In the preferred embodiment, the top cover 28 is also comprised of an aluminum skin and is reinforced with L-shaped angle sections 34 at its outer edges which cooperate to define the top cover 28 with a downwardly inclined portion. FIGS. 4 and 5 show a front elevation view of the preferred embodiment. Although a single contour is shown on the contour flap 30, the scope of the present invention includes the use of additional contours to more closely approximate the shape of any aircraft or other conventional cargo carriers.

Figure 6:
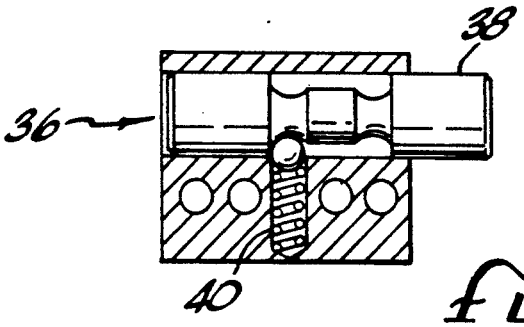
FIG. 6 is a section view illustrating the locking means used in the preferred embodiment of the present invention.

As shown in FIGS. 2 through 5, securing the top cover 28 and the contour flap 30 into the desired configuration are a plurality of locking means 36. By raising the top cover 28, it is secured in the AQ7 configuration by only several of the locking means 36 near the edge of the box structure 16. As shown in FIG. 6, the locking means 36 may consist of a piston 38 and spring 40 assembly.

While specific embodiments of the invention herein claimed have been described and shown, it will be apparent to those skilled in the art that many modifications on these embodiments are possible without departing from the inventive concepts herein claimed. Accordingly, this patent and the protection provided hereby is no limited to the specific embodiments set forth above, but is of the full breadth and scope of the appended claims.

What is claimed is:

1. A convertible air cargo container comprising a slidable top cover and a contour flap secured to said top cover by a hinge said container having a rectangular base and an approximate uniform height of 96 inches which may be converted to having an approximate maximum height of 118 inches and a variable height portion along said contour flap varying from approximately 96 inches to 118 inches by the repositioning of said slidable top cover which increase the interior volume of the container and by the angular rotation of said contour flap about said hinge to substantially conform to the interior cabin shape of a cargo aircraft.

2. A convertible air cargo container comprising a substantially rectangular base, opposing side walls rising from said base with at least one of said side walls provided with a door opening for access to the interior of said container, a door secured adjacent to said door opening and shaped complementary for closing said door opening and a plurality of support posts cooperating to define a box structure, further comprising a top cover comprised of a contour flap secured to said top cover by a pivoting means, said top cover and said box structure telescoped together in a first position with the interior surface of said top cover in close communication with the exterior surface of said box structure to make the convertible container substantially closed, with both said top cover and said contour flap releasably secured to said box structure, said top cover moveable along a portion of the periphery of said box structure in a telescope fashion to a second substantially closed position, said contour flap rotated about said pivoting means to substantially conform to the curvature of the cabin side wall of an aircraft fuselage in said second position, with said top cover and the contour flap releasably secured to said box structure in said second position.

3. The cargo container of claim 2 wherein the height dimension of said container is approximately 96 inches when said top cover and said contour flap are in the first position and the height dimension of said container when said top cover and said contour flap are in the second position is variable along the contour flap, said height varying from approximately 96 inches to a maximum height of approximately 118 inches.

4. The air cargo container of claim 2 where said top cover and said contour flap are releasably secured in the first and second positions by a plurality of locking means.

5. A convertible air cargo container comprising a substantially rectangular base, support posts extending upwardly therefrom, horizontal support posts, side sheets spanning between said support posts and defining a box structure with an upper opening having at least one of said side sheets with a door opening and a door connected thereto for closing said door opening, said box structure comprising:

(a) a top cover, demountably coupled onto said box structure over the upper opening to make the convertible container substantially closed and having a complementary shape so as to telescopically slide along a portion of the exterior periphery of said box structure in a rectilinear fashion between a lowered position and at least one raised position, said top cover comprised of angle sections and panels therebetween cooperating to define an inclined portion on said top cover and comprised of a pivoting means affixed adjacent to said inclined portion;

(b) a contour flap attached to said pivoting means and rotatable about the pivoting means to contact said inclined portion of the top cover to substantially match the curvature of the interior cabin of an aircraft fuselage when the top cover is releasably secured in said raised position; and (c) a plurality of locking means releasably securing said slidable top cover and the contour flap to said box structure in said raised and lowered positions.

6. A convertible air cargo container comprising a substantially rectangular base, support posts extending upwardly therefrom, horizontal support posts, side sheets spanning between said support posts defining a box structure with an upper opening and having at least one of said side sheets with a door opening and a door connected thereto for closing said door opening, and comprising:

(a) notches having sloped surfaces and placed on two opposing horizontal support posts of said box structure;

(b) a top cover, demountably coupled onto said box structure over the upper opening and making said convertible container substantially closed, said top cover having a complementary shape so as to telescopically slide along a portion of the exterior periphery of said box structure between a lowered position and at least one raised position, said sop cover comprised of L-shaped angle sections and panels therebetween cooperating to define an inclined portion on said top cover and comprising a pivoting means affixed adjacent to said inclined portion;

(c) a contour flap attached to said pivoting means and rotatable to contact said inclined portion of the top cover to substantially match the curvature of the interior cabin of a cargo vehicle, said contour flap shaped complementary to said sloped surfaces on said notches and positioned in close proximity to said notches when the top cover is positioned in said raised position; and (d) a plurality of locking means releasably securing said slidable top cover an the contour flap to said box structure in said raised and lowered positions.

7. The air cargo container of claim 5 or claim 6 where said box structure, top cover and contour flap are comprised of aluminum material.

8. The air cargo container of claim 5 or claim 6 wherein said lowered position defines a substantially cube shaped container and said raised position increases the dimension of said container in the direction of movement of the top cover.

9. The air cargo container of claim 5 or claim 6 wherein said top cover and the contour flap integrally form a substantially trapezoidal shape in cross-section in said raised position.

10. The air cargo container of claims 4, 5 or 6 wherein said locking means is comprised of a piston and spring assembly.

11. A convertible air cargo container comprising a substantially closed box structure comprised of a rectangular base, a top cover slidable secured to said box structure, a contour flap secured to said top cover by a hinge, said container having a uniform height of approximately 96 inches with said container being convertible to a different configuration having a maximum height of approximately 118 inches and a variable height of approximately 96 inches to 118 inches and a variable height of approximately 96 inches to 118 inches along the length of said contour flap by repositioning said top cover on said box structure to increase the interior volume of said container and by the rotation of said contour flap about said hinge to substantially conform to the interior cabin shape of an aircraft fuselage.

12. A convertible air cargo container comprising a substantially rectangular base, support posts extending upwardly therefrom, horizontal support posts, side sheets placed between said support posts and defining a box structure with an upper opening having at least one of said side sheets with a door opening and a door connected thereto for closing said door opening and further comprising:

a top cover slidable secured onto said box structure over the upper opening, said top cover sized so as to slide in rectilinear motion along a portion of the exterior periphery of said box structure, said top cover comprised of an inclined portion and a pivoting means affixed adjacent to said inclined portion, said top cover capable of being positioned in raised and lowered positions on said box structure, said raised and lowered positions making the container substantially closed;

a contour flap, coupled to said pivoting means and contiguous with said inclined portion when the top cover is in a raised position and supported upon said box structure when said top cover is in a lowered position; and a plurality of locking means releasably securing said slidable top cover and the contour flap to said box structure when the top cover is in said raised and lowered positions

13. The convertible air cargo container of claim 12 wherein said top cover and said contour flap are comprised of aluminum material and a plurality of L-shaped angle sections.

14. The convertible air cargo container of claim 12 wherein said locking means is a piston and spring assembly.

* * * * *

UNITED STATES PATENT AND TRADEMARK OFFICE

CERTIFICATE OF CORRECTION

PATENT NO. : 5,217,132

DATED : June 8, 1993

INVENTOR(S) : Looker, Robert

It is certified that error appears in the above-identified patent and that said Letters Patent is hereby corrected as shown below:

Column 1, line 30, delete "mostused" and insert -- most used --.

IN THE CLAIMS:

Claim 2, column 4, lines 5 and 15 delete "pivoting" and insert -- pivot --.

Claim 5, column 4, lines 50, 52 and 53 delete "pivoting" and insert -- pivot --.

Claim 6, column 5, line 10 delete "sop" and insert -- top --.

Claim 6, column 5, lines 14 and 16 delete "pivoting" and insert -- pivot --.

Signed and Sealed this

Thirty-first Day of January, 1995

*Attest:*

Bruce Lehman

BRUCE LEHMAN

*Attesting Officer*

*Commissioner of Patents and Trademarks*